US009125472B2

(12) United States Patent
Lin

(10) Patent No.: US 9,125,472 B2
(45) Date of Patent: Sep. 8, 2015

(54) COSMETIC POWDER CONTAINER

(71) Applicant: Hsiao-Yun Lin, Lukang Township, Changhua County (TW)

(72) Inventor: Hsiao-Yun Lin, Lukang Township, Changhua County (TW)

( * ) Notice: Subject to any disclaimer, the term of this patent is extended or adjusted under 35 U.S.C. 154(b) by 0 days.

(21) Appl. No.: 14/229,872

(22) Filed: Mar. 29, 2014

(65) Prior Publication Data

US 2015/0047670 A1 Feb. 19, 2015

(30) Foreign Application Priority Data

Aug. 14, 2013 (CN) ..... 2013 2 0495183 U

(51) Int. Cl.
*A45D 33/06* (2006.01)

(52) U.S. Cl.
CPC ..... *A45D 33/06* (2013.01)

(58) Field of Classification Search
CPC ..... A45D 33/00; A45D 33/003; A45D 33/02; A45D 33/04; A45D 33/08; A45D 33/10; A45D 33/16; A45D 33/06; A45D 2033/00
See application file for complete search history.

(56) References Cited

U.S. PATENT DOCUMENTS 8,047,214 B2 * 11/2011 Thorpe et al. ..... 132/299
2010/0119287 A1 * 5/2010 Thorpe et al. ..... 401/24

* cited by examiner

*Primary Examiner* — Rachel Steitz

(57) ABSTRACT

A cosmetic powder container includes a container for receiving cosmetic powders, a makeup tool for applying the cosmetic powders out of the container, and a soft press disc for moving the cosmetic powders in the container to the makeup tool. The container includes a top end having a first opening. The container further includes a bottom end having a through-hole. The soft press disc is coupled to the bottom end of the container and seals the through-hole. The makeup tool is mounted to the top end of the container. In use, a user can directly press the soft press disc to push the cosmetic powders to eject out of the container and adhere to the makeup tool mounted to the top end of the container instead of touching or grabbing the cosmetic powders. The whole procedure is very convenient and sanitary.

4 Claims, 7 Drawing Sheets

COSMETIC POWDER CONTAINER

BACKGROUND OF THE INVENTION

The present invention relates to a cosmetic tool and, more particularly, to a cosmetic powder container.

Cosmetic powders are widely used in makeup and maintenance of human eye portions. New cosmetic powder container products continually emerge into the market and generally have slight differences in the appearances of the cosmetic powder containers. Improvement to the internal structure of the cosmetic powder containers is ignored. Conventional cosmetic powder containers are a plastic box or glass bottle receiving cosmetic powders. In use, a user directly grab a pinch of cosmetic powders with fingers to proceed with powder makeup on the skin (such as the face or neck). However, the conventional cosmetic powder containers require the user to directly grab the cosmetic powders with fingers, which is not only inconvenient to use but insanitary while adversely affecting the health.

Thus, a need exists for a novel cosmetic powder container which is not only sanitary but allows convenient use during makeup.

BRIEF SUMMARY OF THE INVENTION

An objective of the present invention is to provide a cosmetic powder container which is not only sanitary but allows convenient use during makeup to solve the disadvantages of the prior art.

To fulfill the above objective, a cosmetic powder container according to the present invention includes a container adapted for receiving cosmetic powders, a makeup tool adapted for applying the cosmetic powders out of the container, and a soft press disc adapted for moving the cosmetic powders in the container to the makeup tool. The container includes a top end having a first opening. The container further includes a bottom end having a through-hole. The soft press disc is coupled to the bottom end of the container and seals the through-hole. The makeup tool is mounted to the top end of the container.

Preferably, the container includes a lower receiving body and an upper rotational member above the lower receiving body. The upper rotational member includes a top end forming the top end of the container. The first opening is defined in the top end of the upper rotational member. The upper rotational member includes an inner periphery having a protrusion. The lower receiving body includes a bottom end forming the bottom end of the container. The lower receiving body further includes a top end having a second opening. The lower receiving body further includes a sliding groove in an intermediate portion of an outer wall of the lower receiving body. The upper rotational member is mounted around the outer wall of the lower receiving body. The protrusion of the upper rotational member is slideably received in the sliding groove of the lower receiving body.

The sliding groove includes an open position and a closed position. The first opening of the upper rotational member is aligned with the second opening of the lower receiving body when the protrusion of the upper rotational member is in the open position of the sliding groove. On the other hand, the first opening of the upper rotational member is not aligned with the second opening of the lower receiving body when the protrusion of the upper rotational member is in the closed position of the sliding groove. The makeup tool is mounted on the top end of the upper rotational member.

Preferably, the cosmetic powder container further includes an annular base. The annular base includes an annular engagement section extending from a side of the annular base. The annular engagement section includes an inner periphery having a first annular groove. The annular engagement section further includes an outer periphery having a first flange. The soft press disc includes a second flange on an outer periphery thereof. The bottom end of the lower receiving body includes an annular engagement groove. The annular engagement groove of the lower receiving body includes an inner face having a second annular groove. The soft press disc is engaged in the annular engagement groove of the lower receiving body. The annular engagement section of the annular base is engaged in the annular engagement groove of the lower receiving body. The annular base tightly presses against the soft press disc. The second flange of the soft press disc is engaged with the first annular groove. The first flange of the annular base is engaged with the second annular groove.

Preferably, the sliding groove includes two ribs separating the sliding groove into a left sliding groove section, a middle sliding groove section, and a right sliding groove section. The first opening of the upper rotational member is not aligned with the second opening of the lower receiving body when the protrusion of the upper rotational member is in the left sliding groove section or the right sliding groove section. On the other hand, the first opening of the upper rotational member is aligned with the second opening of the lower receiving body when the protrusion of the upper rotational member is in the middle sliding groove section.

Preferably, the makeup tool is a sponge. The sponge is mounted to the top end of the upper rotational member.

Preferably, the cosmetic powder container further includes a support tube mounted between the sponge and the upper rotational member.

Preferably, the cosmetic powder container further includes a cap. The cap is mounted around an outer wall of the upper rotational member.

Preferably, the cap includes an inner wall having a plurality of knurls spaced from each other at regular intervals. The outer wall of the upper rotational member includes an annular rib. The plurality of knurls of the cap is engaged with a lower edge of the annular rib of the upper rotational member when the cap is mounted around the upper rotational member.

The cosmetic powder container according to the present invention provides advantageous effects. In use, the soft press disc coupled to the bottom end of the container is pressed and deforms inward, providing an inward push force. The cosmetic powders in the container are pushed by the push force through the opening in the top end of the container and adhere to the makeup tool mounted to the top end of the container. The makeup tool can directly contact the skin of a human body for powder makeup. Thus, a user using the cosmetic powder container does not have to touch or grab the cosmetic powders during makeup. Instead, by pressing the soft press disc to create a push force pushing the cosmetic powders, the cosmetic powders eject out of the container and adhere to the makeup tool mounted to the top end of the container. The whole procedure is very convenient and sanitary.

The present invention will become clearer in light of the following detailed description of illustrative embodiments of this invention described in connection with the drawings.

DETAILED DESCRIPTION OF THE INVENTION

Figure 1:
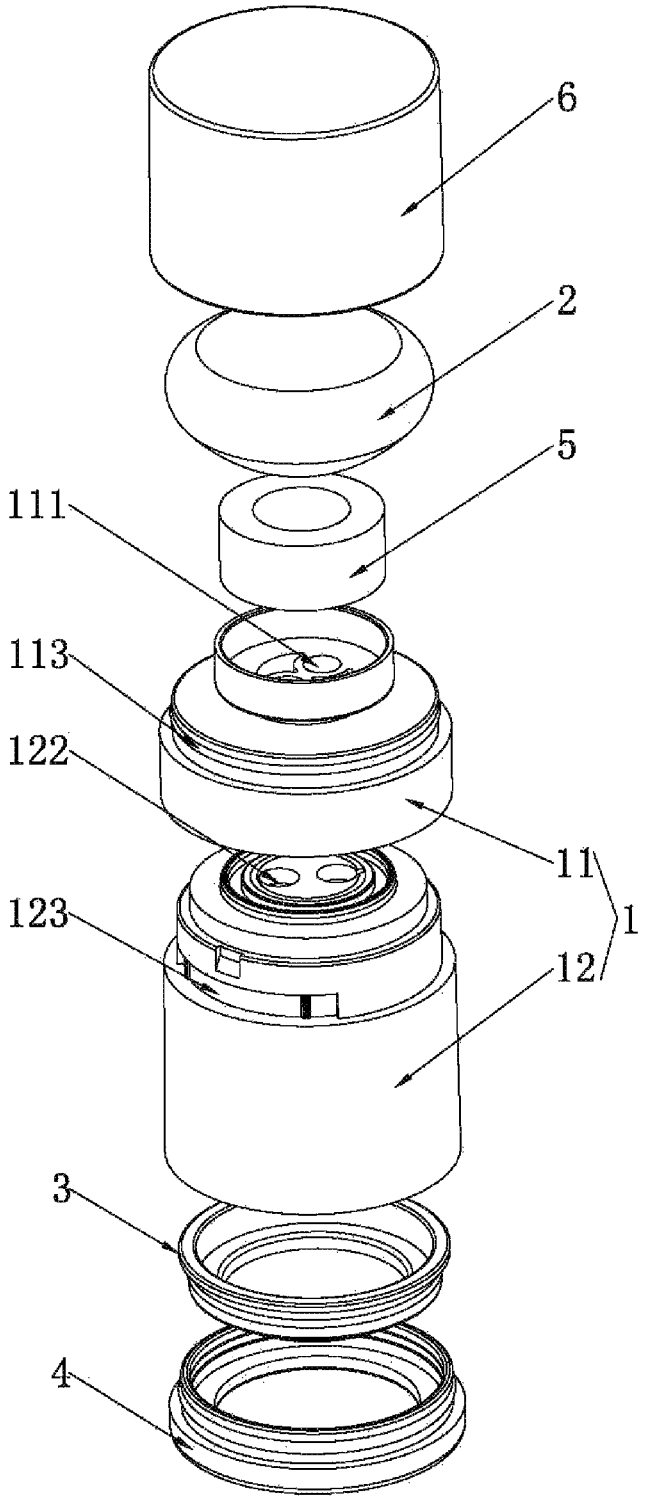
FIG. 1 is an exploded, perspective view of a cosmetic powder container according to the present invention.
Figure 2:
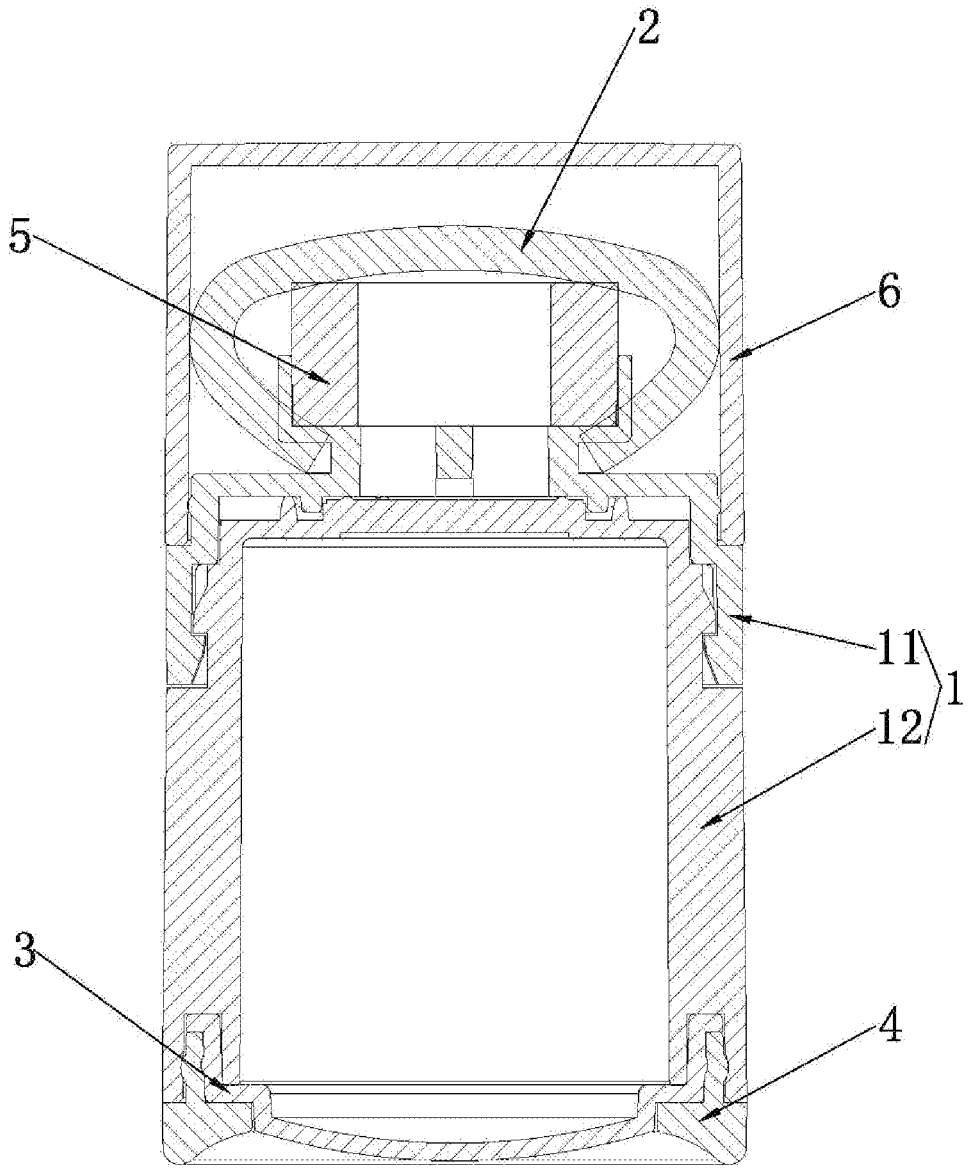
FIG. 2 is a cross sectional view of the cosmetic powder container according to the present invention.
Figure 3:
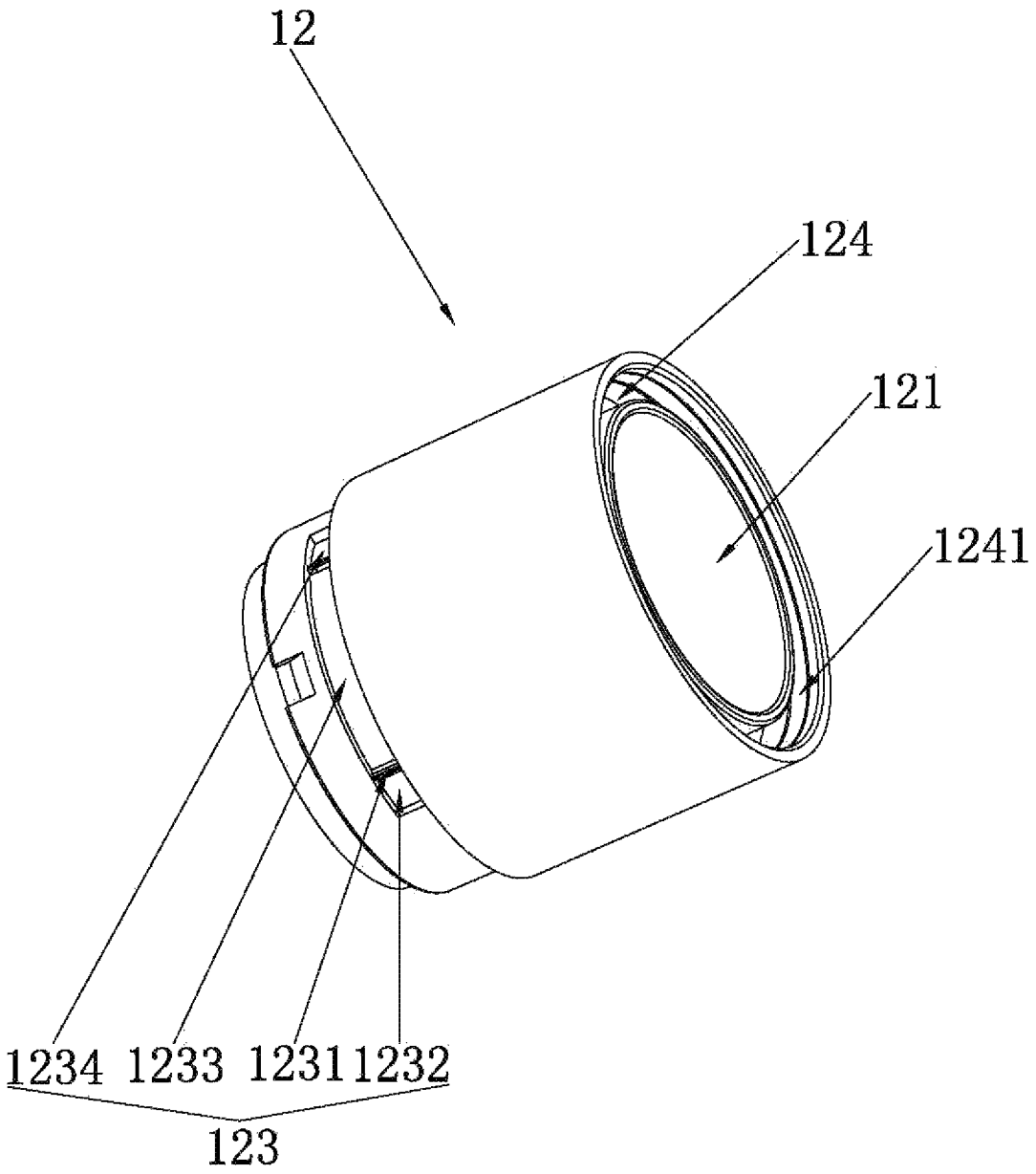
FIG. 3 is a perspective view of a lower receiving body of the cosmetic powder container according to the present invention.

With reference to FIGS. 1-7, a cosmetic powder container according to the present invention includes a container 1 adapted for receiving cosmetic powders, a makeup tool adapted for applying the cosmetic powders out of the container 1, and a soft press disc 3 adapted for moving the cosmetic powders in the container 1 to the makeup tool. The container 1 includes a top end having a first opening 111. The container 1 further includes a bottom end having a through-hole 121. The soft press disc 3 is coupled to the bottom end of the container 1 and seals the through-hole 121. The makeup tool is mounted to the top end of the container 1.

The soft press disc 3 is made of soft rubber and, thus, has better elasticity. In use, the soft press disc 3 coupled to the bottom end of the container 1 is pressed and deforms inward, providing an inward push force. The cosmetic powders in the container 1 are pushed by the push force through the opening 111 in the top end of the container 1 and adhere to the makeup tool mounted to the top end of the container 1. The makeup tool can directly contact the skin of a human body for powder makeup. Thus, a user using the cosmetic powder container does not have to touch or grab the cosmetic powders during makeup. Instead, by pressing the soft press disc 3 to create a push force pushing the cosmetic powders, the cosmetic powders eject out of the container 1 and adhere to the makeup tool mounted to the top end of the container 1. The whole procedure is very convenient and sanitary.

In this embodiment, the container 1 includes a lower receiving body 12 and an upper rotational member 11 above the lower receiving body 12. The upper rotational member 11 includes a top end forming the top end of the container 1. The first opening 111 is defined in the top end of the upper rotational member 11. The upper rotational member 11 includes an inner periphery having a protrusion 112. The lower receiving body 12 includes a bottom end forming the bottom end of the container 1. The lower receiving body 12 further includes a top end having a second opening 122. The lower receiving body 12 further includes a sliding groove 123 in an intermediate portion of an outer wall of the lower receiving body 12. The upper rotational member 11 is mounted around the outer wall of the lower receiving body 12. The protrusion 112 of the upper rotational member 11 is slideably received in the sliding groove 123 of the lower receiving body 12. The sliding groove 123 includes an open position and a closed position.

The first opening 111 of the upper rotational member 11 is aligned with the second opening 122 of the lower receiving body 12 when the protrusion 112 of the upper rotational member 11 is in the open position of the sliding groove 123. On the other hand, the first opening 111 of the upper rotational member 11 is not aligned with the second opening 122 of the lower receiving body 12 when the protrusion 112 of the upper rotational member 11 is in the closed position of the sliding groove 123. The makeup tool is mounted on the top end of the upper rotational member 11.

In the form shown, the sliding groove 123 including two ribs 1231 separating the sliding groove 123 into a left sliding groove section 1232, a middle sliding groove section 1233, and a right sliding groove section 1234. The first opening 111 of the upper rotational member 11 is not aligned with the second opening 122 of the lower receiving body 12 when the protrusion 112 of the upper rotational member 11 is in the left sliding groove section 1232 or the right sliding groove section 1234. On the other hand, the first opening 111 of the upper rotational member 11 is aligned with the second opening 122 of the lower receiving body 12 when the protrusion 112 of the upper rotational member 11 is in the middle sliding groove section 1233.

When the upper rotational member 11 is rotated, the protrusion 112 on the inner periphery of the upper rotational member 11 slides in the sliding groove 123 in the outer wall of the lower receiving body 12. When the protrusion 112 of the upper rotational member 11 slides to the left sliding groove section 1232 or the right sliding groove section 1234, one of the ribs 1231 stops a side of the protrusion 112, and the top portion of the upper rotational member 11 seals the second opening 122 of the lower receiving body 12. Thus, the interior of the lower receiving body 12 forms a sealed structure to prevent the cosmetic powders from being poured or ejecting outward via the second opening 122. When an external force is applied to rotate the upper rotational member 11 again, the first opening 111 is aligned with the second opening 122 when the protrusion 112 slides to the middle sliding groove section 1233. In this case, the cosmetic powders can eject via the second opening 122 and adhere to the makeup tool mounted on the top end of the upper rotational member 11. The makeup tool can directly contact the skin of a human for makeup purposes. After makeup, the upper rotational member 11 is rotated again to a position in which the first opening 111 in the top end of the upper rotational member 11 is not aligned with the second opening 122 in the top end of the lower receiving body 12, sealing the second opening 122 such that the cosmetic powders in the lower receiving body 12 can not be poured or eject outward via the second opening 122 when not in use. The upper rotational member 11 of the present invention can be rotated to open and close the second opening 122 of the lower receiving body 12, assuring that the cosmetic powders received in the lower receiving body 12 can eject outward when in use and assuring that the cosmetic powders are retained in the sealed lower receiving body 12 when not in use. Undesired waste of the cosmetic powders is avoided by the reasonable arrangement.

The cosmetic powder container according to the present invention further includes an annular base 4. The annular base 4 includes an annular engagement section 41 extending from a side of the annular base 4. The annular engagement section 41 includes an inner periphery having a first annular groove 411. The annular engagement section 41 further includes an outer periphery having a first flange 412. Furthermore, the soft press disc 3 includes a second flange 31 on an outer periphery thereof. The bottom end of the lower receiving body 12 includes an annular engagement groove 124. The annular engagement groove 124 of the lower receiving body 12 includes an inner face having a second annular groove 1241.

The soft press disc 3 is engaged in the annular engagement groove 124 of the lower receiving body 12. The annular engagement section 41 of the annular base 4 is also engaged in the annular engagement groove 124 of the lower receiving body 12. The annular base 4 tightly presses against the soft press disc 3. The second flange 31 of the soft press disc 3 is engaged with the first annular groove 411. The first flange 412 of the annular base 4 is engaged with the second annular groove 1241. Since the soft press disc 3 is frequently pressed, it is apt to disengage from the lower receiving body 12 during use. By the provision of the annular base 4 tightly engaged in the engagement groove 124 in the bottom end of the lower receiving body 12 and the mutual engagement between the second flange 31 and the first annular groove 411, the engagement between the first flange 412 and the second annular groove 1241 provides a tight connection between the soft press disc 3 and the lower receiving body 12 without the risks of disengagement of the soft press disc 3. The arrangement is durable and reasonable.

In the form shown, the makeup tool is a sponge 2. The sponge 2 is mounted to the top end of the upper rotational member 11. The sponge 2 has certain elasticity and is soft and fluffy such that the cosmetic powders can easily adhere to the sponge 2. While doing makeup, the sponge 2 directly contacting the skin of the human provides a comfort touch without injuring the skin.

Furthermore, a support tube 5 is mounted between the sponge 2 and the upper rotational member 11. Since the sponge 2 is soft and fluffy, the support tube 5 mounted between the sponge 2 and the upper rotational member 11 supports the sponge 2. Thus, even though an external force is applied during makeup, the sponge 2 can maintain its shape without great deformation adversely affecting the makeup.

In the form shown, the cosmetic powder container further includes a cap 6 mounted around an outer wall of the upper rotational member 11. After use of the cosmetic powder container, the cap 6 is mounted around the upper rotational member 11 to allow easy carriage while providing the sponge 2 on the top end of the upper rotational member 11 with dustproof and waterproof effects. The arrangement is durable and reasonable and provides utility.

Figure 4:
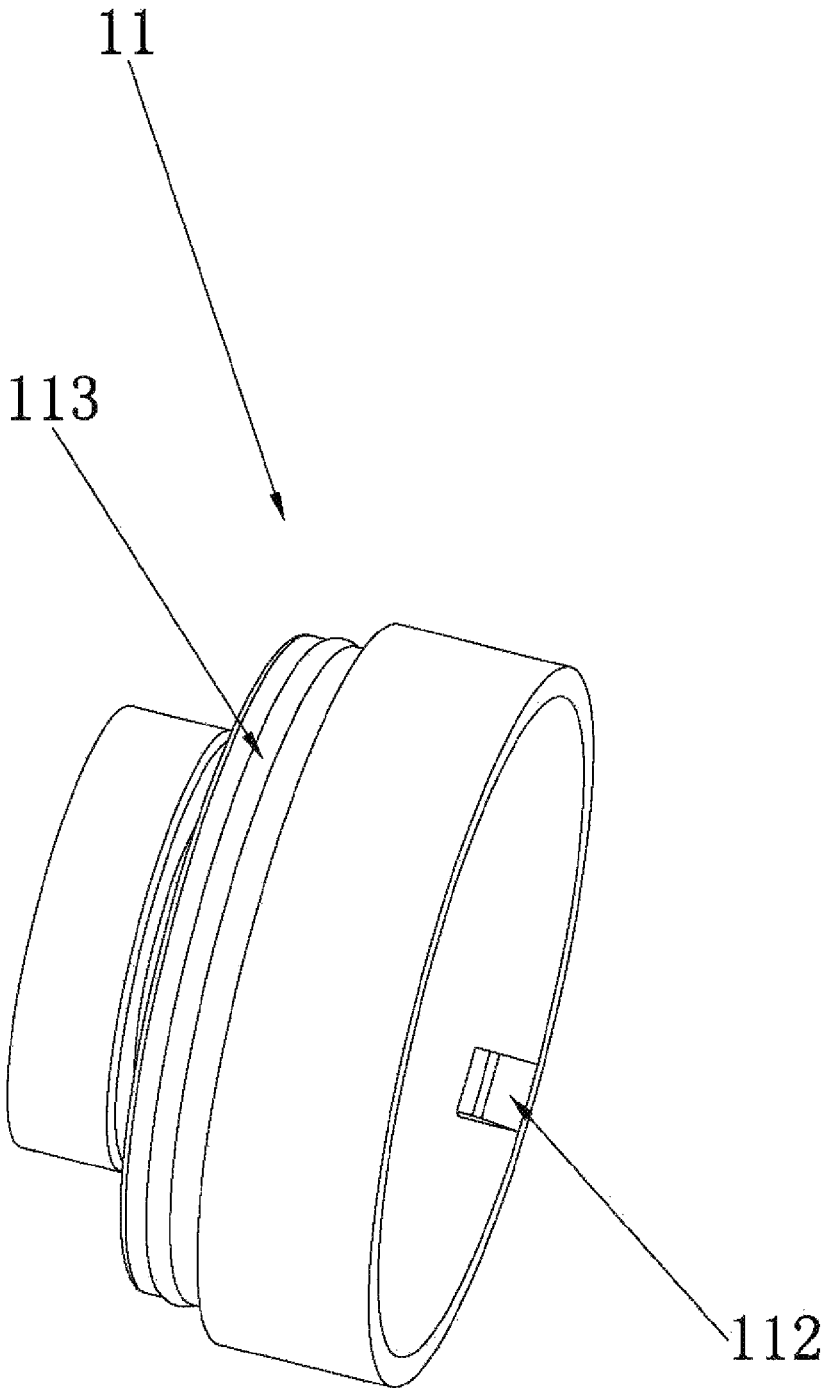
FIG. 4 is a perspective view of an upper rotational member of the cosmetic powder container according to the present invention.
Figure 5:
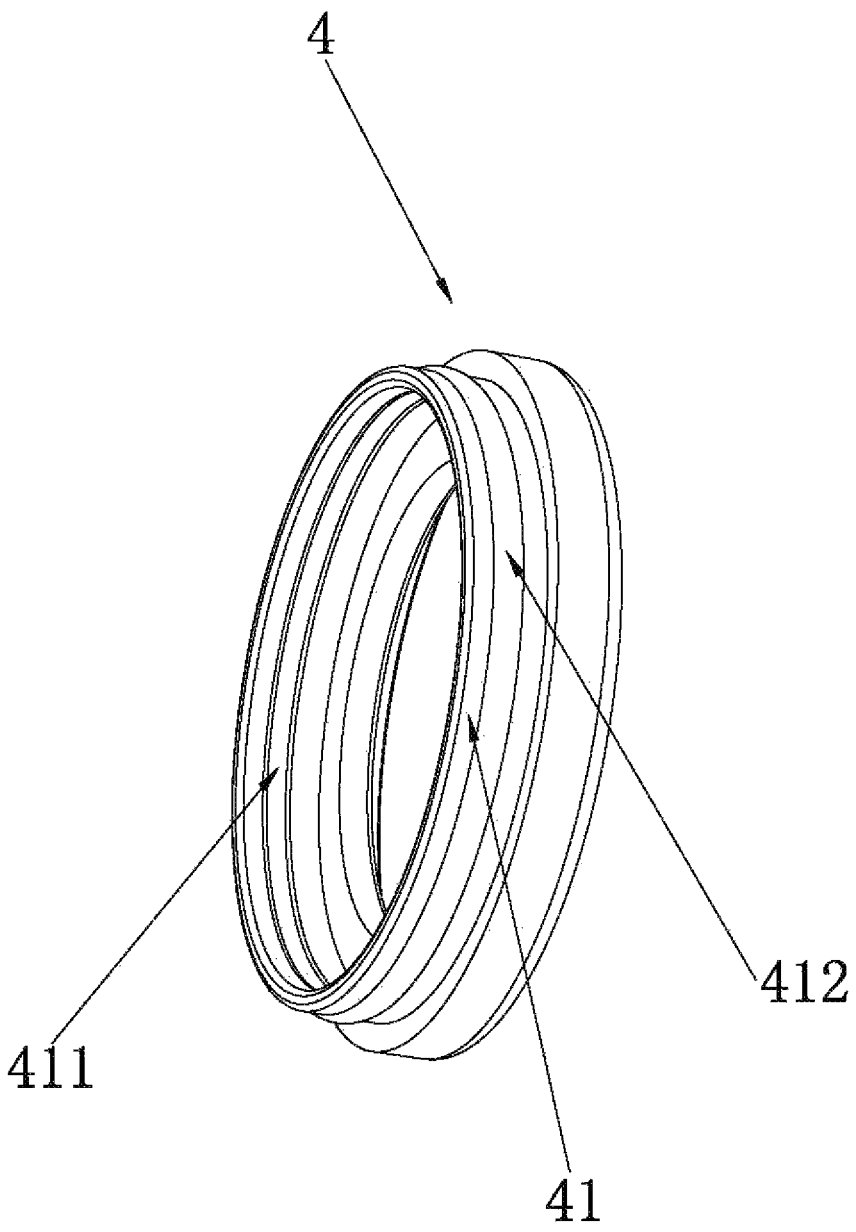
FIG. 5 is a perspective view of an annular base of the cosmetic powder container according to the present invention.
Figure 6:
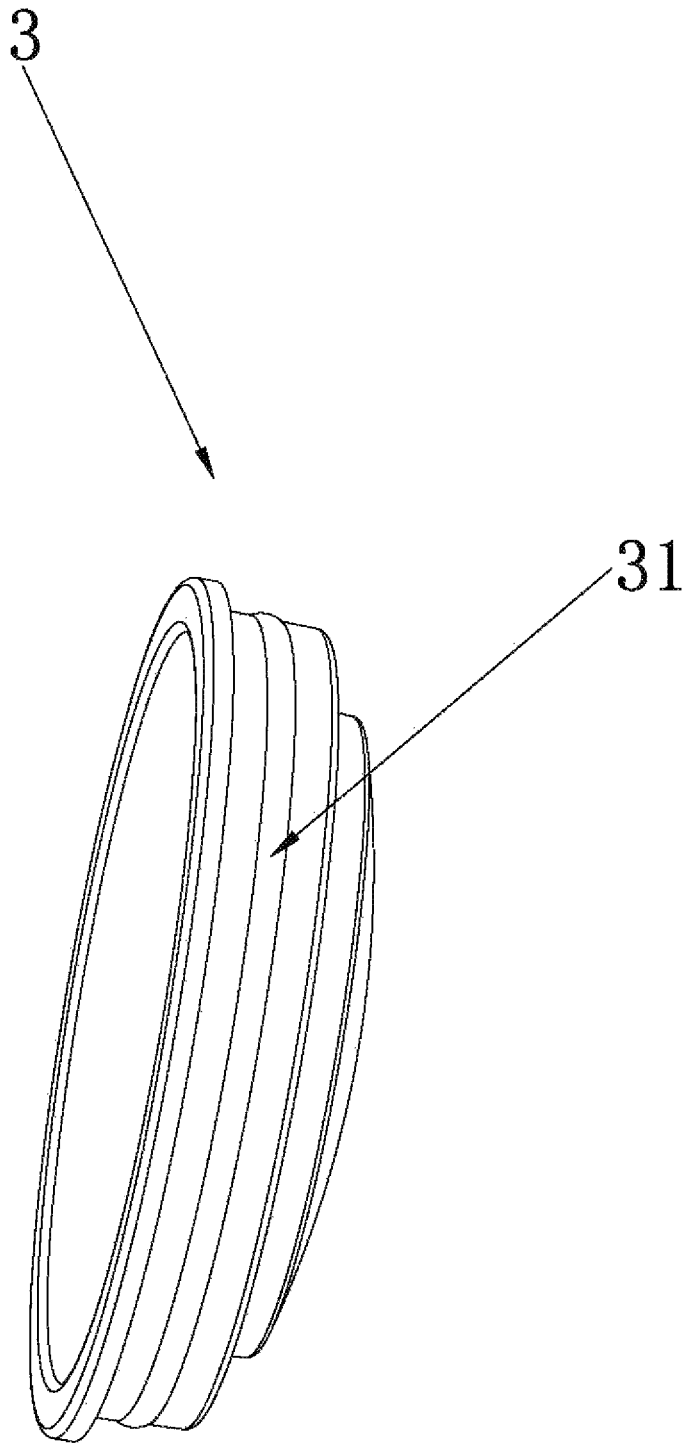
FIG. 6 is a perspective view of a soft press disc of the cosmetic powder container according to the present invention.
Figure 7:
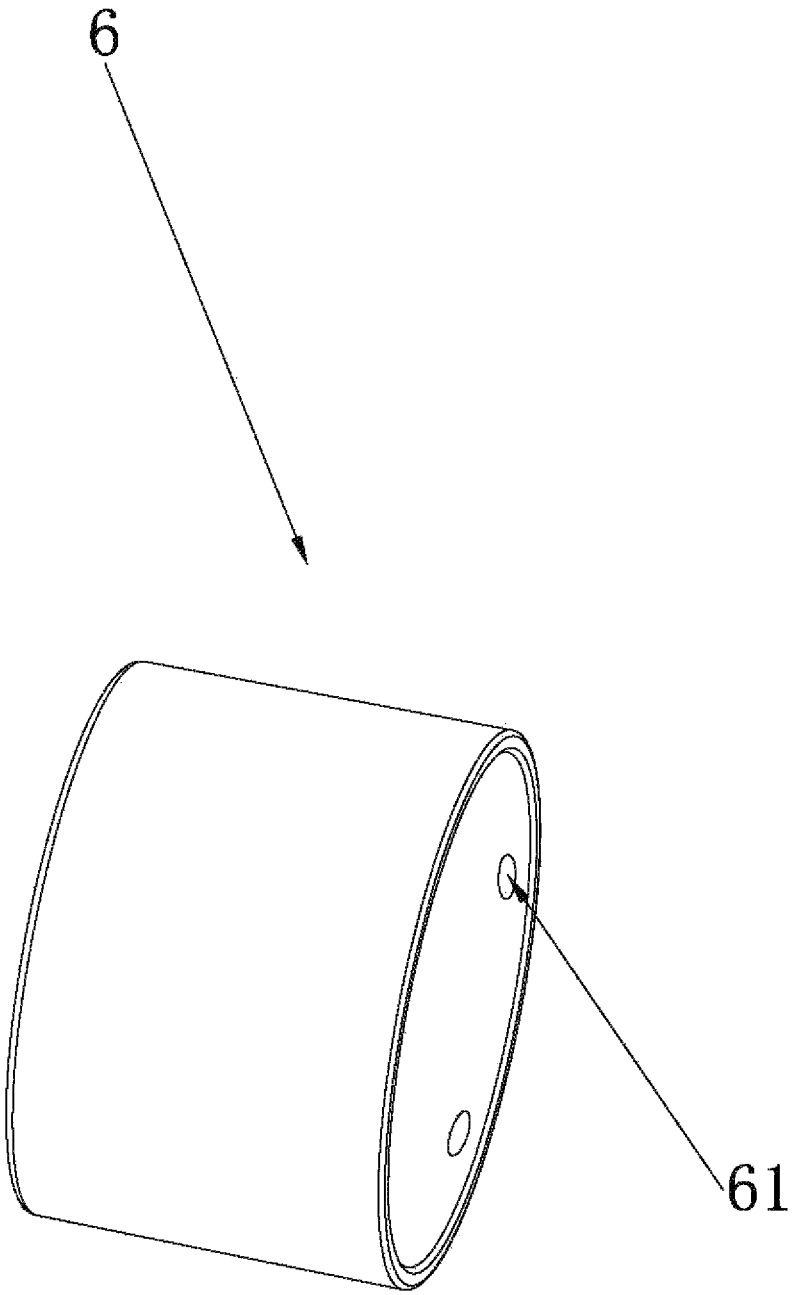
FIG. 7 is a perspective view of a cap of the cosmetic powder container according to the present invention.

With reference to FIGS. 1, 4, and 7, the cap 6 includes an inner wall having a plurality of knurls 61 spaced from each other at regular intervals. Furthermore, the outer wall of the upper rotational member 11 includes an annular rib 113. The knurls 61 of the cap 6 are engaged with a lower edge of the annular rib 113 of the upper rotational member 11 when the cap 6 is mounted around the upper rotational member 11. This arrangement is reasonable and provides stable connection, such that cap 6 is less likely to fall even under normal impact.

Although specific embodiments have been illustrated and described, numerous modifications and variations are still possible without departing from the scope of the invention. The scope of the invention is limited by the accompanying claims.

The invention claimed is:

1. A cosmetic powder container comprising a container adapted for receiving cosmetic powders, a makeup tool adapted for applying the cosmetic powders out of the container, and a soft press disc adapted for moving the cosmetic powders in the container to the makeup tool, with the container including a top end having a first opening, with the container further including a bottom end having a through-hole, with the soft press disc coupled to the bottom end of the container and sealing the through-hole, and with the makeup tool mounted to the top end of the container, with the container including a lower receiving body and an upper rotational member above the lower receiving body, with the upper rotational member including a top end forming the top end of the container, with the first opening defined in the top end of the upper rotational member, with the upper rotational member including an inner periphery having a protrusion, with the lower receiving body including a bottom end forming the bottom end of the container, with the lower receiving body further including a top end having a second opening, with the lower receiving body further including a sliding groove in an intermediate portion of an outer wall of the lower receiving body, with the upper rotational member mounted around the outer wall of the lower receiving body, and with the protrusion of the upper rotational member slideably received in the sliding groove of the lower receiving body, with the sliding groove including an open position and a closed position, with the first opening of the upper rotational member aligned with the second opening of the lower receiving body when the protrusion of the upper rotational member is in the open position of the sliding groove, with the first opening of the upper rotational member not aligned with the second opening of the lower receiving body when the protrusion of the upper rotational member is in the closed position of the sliding groove, with the makeup tool mounted on the top end of the upper rotational member, with the cosmetic powder container further comprising: an annular base, with the annular base including an annular engagement section extending from a side of the annular base, with the annular engagement section including an inner periphery having a first annular groove, with the annular engagement section further including an outer periphery having a first flange, with the soft press disc including a second flange on an outer periphery thereof, with the bottom end of the lower receiving body including an annular engagement groove, with the annular engagement groove of the lower receiving body including an inner face having a second annular groove, with the soft press disc engaged in the annular engagement groove of the lower receiving body, with the annular engagement section of the annular base engaged in the annular engagement groove of the lower receiving body, with the annular base tightly pressing against the soft press disc, and with the second flange of the soft press disc engaged with the first annular groove, with the first flange of the annular base engaged with the second annular groove.

2. A cosmetic powder container comprising a container adapted for receiving cosmetic powders, a makeup tool adapted for applying the cosmetic powders out of the container, and a soft press disc adapted for moving the cosmetic powders in the container to the makeup tool, with the container including a top end having a first opening, with the container further including a bottom end having a through-hole, with the soft press disc coupled to the bottom end of the container and sealing the through-hole, and with the makeup tool mounted to the top end of the container, with the container including a lower receiving body and an upper rotational member above the lower receiving body, with the upper rotational member including a top end forming the top end of the container, with the first opening defined in the top end of the upper rotational member, with the upper rotational member including an inner periphery having a protrusion, with the lower receiving body including a bottom end forming the bottom end of the container, with the lower receiving body further including a top end having a second opening, with the lower receiving body further including a sliding groove in an intermediate portion of an outer wall of the lower receiving body, with the upper rotational member mounted around the outer wall of the lower receiving body, and with the protrusion of the upper rotational member slideably received in the sliding groove of the lower receiving body, with the sliding groove including an open position and a closed position, with the first opening of the upper rotational member aligned with the second opening of the lower receiving body when the protrusion of the upper rotational member is in the open position of the sliding groove, with the first opening of the upper rotational member not aligned with the second opening of the lower receiving body when the protrusion of the upper rotational member is in the closed position of the sliding groove, with the makeup tool mounted on the top end of the upper rotational member, with the sliding groove including two ribs separating the sliding groove into a left sliding groove section, a middle sliding groove section, and a right sliding groove section, with the first opening of the upper rotational member not aligned with the second opening of the lower receiving body when the protrusion of the upper rotational member is in the left sliding groove section or the right sliding groove section, and with the first opening of the upper rotational member aligned with the second opening of the lower receiving body when the protrusion of the upper rotational member is in the middle sliding groove section.

3. A cosmetic powder container comprising a container adapted for receiving cosmetic powders, a makeup tool adapted for applying the cosmetic powders out of the container, and a soft press disc adapted for moving the cosmetic powders in the container to the makeup tool, with the container including a top end having a first opening, with the container further including a bottom end having a through-hole, with the soft press disc coupled to the bottom end of the container and sealing the through-hole, and with the makeup tool mounted to the top end of the container, with the container including a lower receiving body and an upper rotational member above the lower receiving body, with the upper rotational member including a top end forming the top end of the container, with the first opening defined in the top end of the upper rotational member, with the upper rotational member including an inner periphery having a protrusion, with the lower receiving body including a bottom end forming the bottom end of the container, with the lower receiving body further including a top end having a second opening, with the lower receiving body further including a sliding groove in an intermediate portion of an outer wall of the lower receiving body, with the upper rotational member mounted around the outer wall of the lower receiving body, and with the protrusion of the upper rotational member slideably received in the sliding groove of the lower receiving body, with the sliding groove including an open position and a closed position, with the first opening of the upper rotational member aligned with the second opening of the lower receiving body when the protrusion of the upper rotational member is in the open position of the sliding groove, with the first opening of the upper rotational member not aligned with the second opening of the lower receiving body when the protrusion of the upper rotational member is in the closed position of the sliding groove, with the makeup tool mounted on the top end of the upper rotational member, with the makeup tool being a sponge, with the sponge mounted to the top end of the upper rotational member, and with the cosmetic powder container further comprising: a support tube mounted between the sponge and the upper rotational member.

4. A cosmetic powder container comprising a container adapted for receiving cosmetic powders, a makeup tool adapted for applying the cosmetic powders out of the container, and a soft press disc adapted for moving the cosmetic powders in the container to the makeup tool, with the container including a top end having a first opening, with the container further including a bottom end having a through-hole, with the soft press disc coupled to the bottom end of the container and sealing the through-hole, and with the makeup tool mounted to the top end of the container, with the container including a lower receiving body and an upper rotational member above the lower receiving body, with the upper rotational member including a top end forming the top end of the container, with the first opening defined in the top end of the upper rotational member, with the upper rotational member including an inner periphery having a protrusion, with the lower receiving body including a bottom end forming the bottom end of the container, with the lower receiving body further including a top end having a second opening, with the lower receiving body further including a sliding groove in an intermediate portion of an outer wall of the lower receiving body, with the upper rotational member mounted around the outer wall of the lower receiving body, and with the protrusion of the upper rotational member slideably received in the sliding groove of the lower receiving body, with the sliding groove including an open position and a closed position, with the first opening of the upper rotational member aligned with the second opening of the lower receiving body when the protrusion of the upper rotational member is in the open position of the sliding groove, with the first opening of the upper rotational member not aligned with the second opening of the lower receiving body when the protrusion of the upper rotational member is in the closed position of the sliding groove, with the makeup tool mounted on the top end of the upper rotational member, and with the cosmetic power container further comprising a cap mounted around an outer wall of the upper rotational member, with the cap including an inner wall having a plurality of knurls spaced from each other at regular intervals, with the outer wall of the upper rotational member including an annular rib, with the plurality of knurls of the cap engaged with a lower edge of the annular rib of the upper rotational member when the cap is mounted around the upper rotational member.

* * * * *